United States Patent [19]

Shinopulos et al.

[11] 4,211,270

[45] Jul. 8, 1980

[54] METHOD FOR CONTINUOUS CASTING OF METALLIC STRANDS AT EXCEPTIONALLY HIGH SPEEDS

[75] Inventors: George Shinopulos; M. Ronald Randlett, both of Burlington; Terry F. Bower, Needham, all of Mass.

[73] Assignee: Kennecott Copper Corporation, New York, N.Y.

[21] Appl. No.: 928,881

[22] Filed: Jul. 28, 1978

[51] Int. Cl.[2] ..... B22D 11/00

[52] U.S. Cl. ..... 164/83; 164/89; 164/82

[58] Field of Search ..... 164/82, 83, 137, 416, 164/418, 435, 85, 89

[56] References Cited

U.S. PATENT DOCUMENTS

| | | | |
|---|---|---|---|
| 2,135,183 | 11/1938 | Junghans | 164/83 |
| 2,135,184 | 11/1938 | Junghans | 164/450 |
| 2,171,132 | 8/1939 | Simons | 164/64 |
| 2,553,921 | 5/1951 | Jordan | 164/421 |
| 3,300,824 | 1/1967 | Ross | 164/66 |
| 3,302,252 | 2/1967 | Woodburn, Jr. | 164/421 |
| 3,354,936 | 11/1967 | Atkin | 164/82 |
| 3,410,333 | 11/1968 | Woodburn, Jr. | 164/83 |
| 3,429,365 | 2/1969 | Schrewe | 164/416 |
| 3,545,528 | 12/1970 | Chang | 164/154 |
| 3,669,176 | 6/1972 | Krall et al. | 164/83 |
| 3,700,024 | 10/1972 | Knell | 164/83 |
| 3,721,288 | 3/1973 | Vogt et al. | 164/83 |
| 3,746,077 | 7/1973 | Lohikoski et al. | 164/421 |
| 3,782,446 | 1/1974 | Walter | 164/260 |
| 3,817,313 | 6/1974 | Gamble et al. | 164/83 |
| 3,866,570 | 2/1975 | Cruzado et al. | 164/86 X |
| 3,872,913 | 3/1975 | Lohikoski | 164/64 |
| 3,881,544 | 5/1975 | Botta, Jr. et al. | 164/260 |
| 3,908,747 | 9/1975 | Kuttner | 164/260 X |
| 3,930,533 | 1/1976 | Rokop et al. | 164/426 |

FOREIGN PATENT DOCUMENTS

| | | | |
|---|---|---|---|
| 936670 | 11/1973 | Canada | 164/418 |
| 969731 | 6/1975 | Canada . | |
| 1914300 | 10/1970 | Fed. Rep. of Germany | 164/418 |
| 2060451 | 7/1971 | Fed. Rep. of Germany . | |
| 531514 | 1/1941 | United Kingdom . | |
| 1087626 | 10/1967 | United Kingdom . | |

OTHER PUBLICATIONS

"The Upcast Method of Producing Copper Wire", *Wire Industry,* Jul. 1976, pp. 565–567.

"Rolling of Bar, Rod, and Section: Copper and Copper Alloys", *Metals Technology,* Jul.–Aug. 1975, pp. 382–395.

*Primary Examiner*—Robert D. Baldwin
*Assistant Examiner*—K. Y. Lin
*Attorney, Agent, or Firm*—John L. Sniado; Anthony M. Lorusso; Peter J. Manus

[57] ABSTRACT

A cooled mold assembly for the continuous, high-speed casting of metallic strands, especially upcasting strands of copper alloys such as brass, has a hollow die in fluid communication with a melt typically held in a casting furnace. A coolerbody surrounds the die in a tight-fitting relationship to form a solidification front in the melt as it advances through the casting zone of the die. The die is preferably slip fit in the coolerbody. A shoulder on the die engages a lower face of the coolerbody and together with a small irregularity on the upper coolerbody wall prevents an axial movement of the die before it thermally expands against the coolerbody. An insulating member located between the die and the coolerbody and below the solidification front fixes the location of that front within a dimensionally uniform area of the die. The insulating member is preferably a ring of a material such as cast silica that has a low coefficient of thermal expansion, a low porosity, and is highly resistant to thermal shock. The insulating member also preferably creates a steep longitudinal temperature gradient at its upper end to promote a high cooling rate over a relatively short casting zone. An insulating hat substantially encloses the coolerbody allowing it to be immersed in the melt and preferably deeply immersed to a level above the casting zone. This mold assembly is preferably used in conjuction with apparatus for drawing the casting through the die in a cycled pattern of forward and reverse strokes characterized by a low frequency, long forward strokes, a high forward velocity and high forward and reverse accelerations.

80 Claims, 10 Drawing Figures

METHOD FOR CONTINUOUS CASTING OF METALLIC STRANDS AT EXCEPTIONALLY HIGH SPEEDS

BACKGROUND OF THE INVENTION

This invention relates in general to casting of metallic strands and more specifically to a cooled mold assembly and withdrawal process for the continuous, high-speed casting of strands of copper and copper alloys including brass.

It is well known in the art to cast indefinite lengths of metallic strands from a melt by drawing the melt through a cooled mold. The mold generally has a die of a refractory material such as graphite cooled by a surrounding water jacket. U.S. Pat. No. 3,354,936 for example, describes a cooled mold assembly sealed into the bottom wall of the melt container to downcast large billets. The force of gravity feeds the melt through the mold. In downcasting, however, there is a danger of a melt "break out" and the melt container must be emptied or tilted to repair or replace the mold or the casting die.

Horizontal casting through a chilled mold has also been tried. Besides the break out and replacement problems of downcasting, gravity can cause a non-uniform solidification resulting in a casting that is not cross-sectionally uniform or having an inferior surface quality.

Finally, various arrangements have been used for upcasting. Early efforts are described in U.S. Pat. No. 2,553,921 to Jordan and U.S. Pat. No. 2,171,132 to Simons. Jordan employs a water cooled, metallic "mold pipe" with an outer ceramic lining that is immersed in a melt. In practice, no suitable metal has been found for the mold pipe, the casting suffers from uneven cooling, and condensed metallic vapors collect in a gap between the mold pipe and the liner due to differences in their coefficients of thermal expansion. Simons also uses a water-cooled "casing" but it is mounted above the melt and a vacuum is required to draw melt up to the casing. A coaxial refractory extension of the casing extends into the melt. The refractory extension is necessary to prevent "mushrooming," that is, the formation of a solid mass of the metal with a diameter larger than that of the cooled casing. As with Jordan, thermally generated gaps, in this instance between the casing and the extension, can collect condensed metal vapors which results in poor surface quality or termination of the casting.

U.S. Pat. Nos. 3,746,077 and 3,872,913 describe more recent upcasting apparatus and techniques. The '913 patent avoids problems associated with thermal expansion differences by placing only the tip of a "nozzle" in the melt. A water-cooled jacket encloses the upper end of the nozzle. Because the surface of the melt is below the cooling zone, a vacuum chamber at the upper end of the nozzle is necessary to draw the melt upwardly to the cooling zone. The presence of the vacuum chamber however limits the rate of strand withdrawal and requires a seal.

The '077 patent avoids the vacuum chamber by immersing a cooling jacket and a portion of an enclosed nozzle into the melt. The immersion depth is sufficient to feed melt to the solidification zone, but it is not deeply immersed. The jacket as well as the interfaces between the jacket and the nozzle are protected against the melt by a surrounding insulating lining. The lower end of the lining abuts the lower outer surface of the nozzle to block a direct flow of the melt to the cooling jacket.

The foregoing systems are commonly characterized as "closed" mold in that the liquid metal communicates directly with the solidification front. The cooled mold is typically fed from an adjoining container filled with the melt. In contrast, an "open" mold system feeds the melt, typically by a delivery tube, directly to a mold where it is cooled very rapidly. Open mold systems are commonly used in downcasting large billets of steel, and occassionally aluminum, copper or brass. However, open mold casting is not used to form products with a small cross section because it is very difficult to control the liquid level and hence the location of the solidification front.

A problem that arises in closed mold casting is a thermal expansion of the bore of the casting die between the beginning of the solidification front and the point of complete solidification termed "bell-mouthing." This condition results in the formation of enlargements of the casting cross section which wedge against a narrower portion of the die. The wedged section can break off and form an immobile "skull." The skulls can either cause the strand to terminate or can lodge on the die and produce surface defects on the casting. Therefore it is important to maintain the dimensional uniformity of the die bore within the casting zone. In the '913 and '077 systems, these problems are controlled by a relatively gentle vertical temperature gradient along the nozzle due in part to a modest cooling rate to produce a generally flat solidification front. With this gentle gradient, acceptable quality castings can be produced only at a relatively slow rate, typically five to forty inches per minute.

Another significant problem in casting through a chilled mold is the condensation of metallic vapors. Condensation is especially troublesome in the casting of brass bearing zinc or other alloys bearing elements which boil at temperatures below the melting temperature of the alloy. Zinc vapor readily penetrates the materials commonly used to form casting dies as well as the usual insulating materials and can condense to liquid in critical regions. Liquid zinc on the die near the solidification front can boil at the surface of the casting resulting in a gassy surface defect. Because of these problems, present casting apparatus and techniques are not capable of commercial production of good quality brass strands at high speeds.

The manner in which the casting is drawn through the chilled mold is also an important aspect of the casting process. A cycled pattern of a forward withdrawal stroke followed by a dwell period is used commercially in conjunction with the mold unit described in the aforementioned U.S. Pat. No. 3,872,913. U.S. Pat. No. 3,908,747 discloses a controlled reverse stroke to form the casting skin, prevent termination of the casting, and compensate for contraction of the casting within the die as it cools. British Pat. No. 1,087,026 also discloses a reverse stroke to partially remelt the casting. U.S. Pat. No. 3,354,936 discloses a pattern of relatively long forward strokes followed by periods where the casting motion is stopped and reversed for a relatively short stroke. This pattern is used in downcasting large billets to prevent inverse segregation. In all of these systems, however, the stroke velocities and net casting velocities are slow. In the '936 system, for example, forward strokes are three to twenty seconds in duration, reverse strokes are one second in duration, and the net velocity is thirteen to fifteen inches per minute.

It is therefore a principal object of this invention to provide a mold assembly and method for the continuous casting of high quality metallic strands and particularly those of copper and copper alloys including brass at production speeds many times faster than those previously attainable with closed mold systems.

Another object of the invention is to provide such a cooled mold assembly for upcasting with the mold assembly immersed in said melt.

A further object is to provide such a mold assembly that accommodates a steep temperature gradient along a casting die, particularly at the lower end of a solidification zone, without the formation of skulls or loss of dimensional uniformity in the casting zone.

Still another object is to provide a casting withdrawal process for use with such a mold assembly to produce high quality strands at exceptionally high speeds.

A further object is to provide a mold assembly with the foregoing advantages that has a relatively low cost of manufacture, is convenient to service and is durable.

SUMMARY OF THE INVENTION

A cooled mold assembly for continuous high-speed casting metallic strands has a hollow die formed of a refractory material. The melt, typcially of copper or copper alloys such as brass is in fluid communication with one end of the die. A coolerbody, preferably water-cooled, encloses the die in a tight-fitting relationship. The coolerbody has a high cooling rate that produces a solidification front within a casting zone of the die spaced from the die end adjacent the melt. The coolerbody, shielded by an insulating hat, is at least partially immersed in the melt. Preferably it is deeply immersed with the level of the melt above the casting zone.

An insulating member that extends toward the melt from a point just below the casting zone controls the radial thermal expansion of the die to ensure that the casting occurs in a dimensionally uniform section of the die and to control bell-mouthing of the die end proximate the melt. The insulating member also provides a steep temperature gradient at the lower end of the casting zone which is conducive to a rapid cooling over a short length of the die. In a preferred form, the die projects into the melt from the lower end of the coolerbody to control mushrooming and to avoid drawing foreign materials into the casting zone. The insulating member is a bushing of a low thermal expansion, low porosity, refractory material held around the die in a counterbore formed in the coolerbody. The die is preferably formed of graphite or boron nitride and is outgassed prior to use. In another form, the die is flush with or terminates above the lower face of the coolerbody and the insulating member is a tubular refractory element located inside the die and extending from the lower end of the die to a point below the casting zone.

The casting is preferably drawn through the mold assembly in a cycle of forward and reverse strokes. For example, for ¾" diameter strand, the net withdrawal speed is preferably in excess of eighty inches per minute with a frequency of approximately 1 to 3 cycles per second. Forward strokes are typically long, such as 1 to 1½ inches, with a high forward velocity of three to twenty inches per second and a high acceleration in excess of gravity (1 g). The reverse strokes are typically short such as 0.08 to 0.13 inch, also with a high acceleration, typically 3 g. A brief dwell period (e.g. 0.1 second) can be introduced at the end of either or both strokes.

The die preferably has a longitudinally uniform cross section. The die can have a slight upwardly narrowing taper or stepped configuration on its inner surface. The die is preferably slip fit into the coolerbody to facilitate replacement. Before the die expands thermally against the coolerbody, it is restrained against axial movement by a slight upset in the mating coolerbody wall and a stepped outer surface that engages the lower face of the coolerbody. Also in the preferred form, a metallic foil sleeve is interposed between the outside insulating member and the counterbore to facilitate removal of the insulator.

The coolerbody preferably has a double wall construction with an annular space between the walls. The inner wall adjacent the die is preferably formed from a sound ingot of age hardened chrome copper alloy; the outer sleeve is preferably formed of stainless steel. The inner and outer walls or "bodies" are preferably bonded at their lower ends by a copper/gold braze joint. Water is typically circulated in a temperature range and flow rate that yields a high cooling rate of the melt advancing through the die while avoiding condensation of water vapor on the mold assembly or the casting. A vapor shield and gaskets are preferably disposed between the immersed end of the coolerbody and the surrounding insulating hat.

These and other objects and features of the invention will become apparent to those skilled in the art from the following detailed description which should be read in light of the accompanying drawings.

DETAILED DESCRIPTION OF THE PREFERRED EMBODIMENTS

Figure 1:
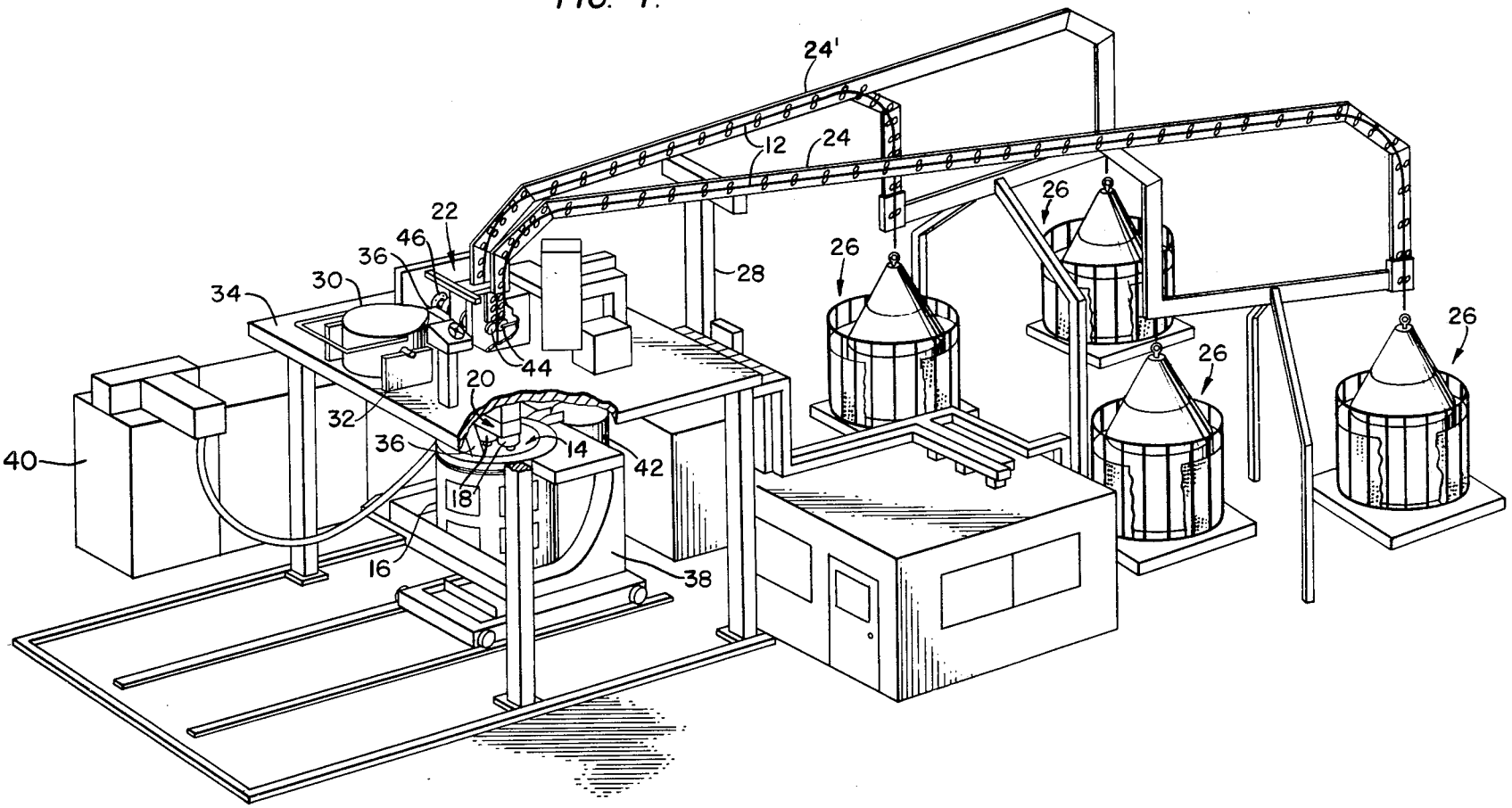
FIG. 1 is a simplified view in perspective of a strand production facility that employs mold assemblies and methods embodying the present invention.

FIG. 1 shows a suitable facility for the continuous production of metallic strands in indefinite lengths by upwardly casting the strands through cooled molds according to this invention. Four strands 12 are cast simultaneously from a melt 14 held in a casting furnace 16. The strands, which can assume a variety of cross sectional shapes such as square or rectangular, will be described as rods having a substantially circular cross section with a diameter in the range of one-quarter to two inches.

With reference to FIGS. 1–7, the strands 12 are cast in four cooled mold assemblies 18 mounted on an insulated water header 20. A withdrawal machine 22 draws the strands through the mold assemblies and directs them to a pair of booms 24, 24' that guide the strands to four pouring type coilers 26 where the strands are collected in coils. Each boom 24 is hollow to conduct cooling air supplied by the ducts 28 along the length of the boom.

The melt 14 is produced in one or several melt furnaces (not shown) or in one combination melting and holding furnace (not shown). While this invention is suitable for producing continuous strands formed from a variety of metals and alloys, it is particularly directed to the production of copper alloy strands, especially brass. A ladle 30 carried by an overhead crane (not shown) transfers the melt from the melt furnaces to the casting furnace 16. The ladle preferably has a teapot-type spout which delivers the melt with a minimum of foreign material such as cover and dross. To facilitate the transfer, the ladle is pivotally seated in support cradle 32 on a casting platform 34. A ceramic pouring cup 36 funnels the melt from the ladle 30 to the interior of the casting furnace 16. The output end of the pouring cup 36 is located below the casting furnace cover and at a point spaced from the mold assemblies 18. In continuous production, as opposed to batch casting, additional melt is added to the casting furnace when it is approximately half full to blend the melt both chemically and thermally.

Figure 7:
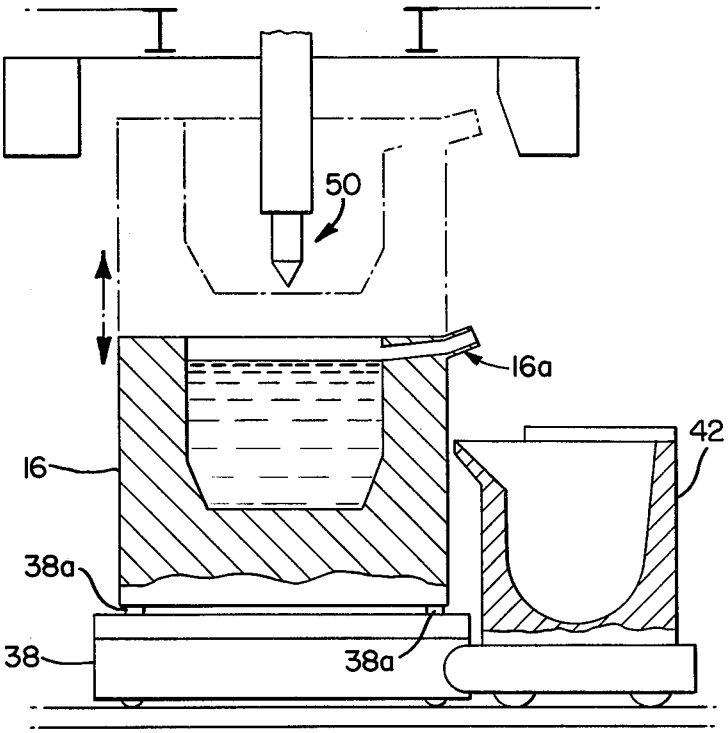
FIG. 7 is a simplified view in vertical section showing the casting furnace shown in FIG. 1 in its lower and upper limit positions with respect to the mold assemblies.

The casting furnace is supported on a hydraulic, scissor-type elevator and dolly 38 (FIG. 7) that includes a set of load cells **38*a* to sense the weight of the casting furnace and its contents. Output signals of the load cells 38*a* are conditioned to control the furnace elevation; this allows automatic control of the level of the melt with respect to the coolerbody. As is best seen in FIG. 7, the casting furnace is movable between a lower limit position in which the mold assemblies 18 are spaced above the upper surface of the melt 14 when the casting furnace is filled and an upper limit position (shown in phantom) in which the mold assemblies are adjacent the bottom of the casting furnace. The height of the casting furnace is continuously adjusted during casting to maintain the selected immersion depth of the mold assemblies 18** in the melt. In the lowered position, the mold assemblies are accessible for replacement or servicing, after the furnace is rolled out of the way.

It should be noted that this production facility usually includes back-up level controls such as probes, floats, and periodic manual measurement as with a dunked wire. These or other conventional level measurement and control systems can also be used instead of the load cells as the primary system. Also, while this invention is described with reference to fixed mold assemblies and a movable casting furnace, other arrangements can be used. The furnace can be held at the same level and melt added periodically or continuously to maintain the same level. Another alternative includes a very deep immersion so that level control is not necessary. A significant advantage of this invention is that it allows this deep immersion. Each of these arrangements has advantages and disadvantages that are readily apparent to those skilled in the art.

The casting furnace 16 is a 38-inch coreless induction furnace with a rammed alumina lining heated by a power supply 40. A furnace of this size and type can hold approximately five tons of melt. The furnace 16 has a pour-off spout 16a that feeds to an overfill and pour-off ladle 42.

The withdrawal machine 22 has four opposed pairs of drive rolls 44 that each frictionally engage one of the strands 12. The rolls are secured on a common shaft driven by a servocontrolled, reversible hydraulic motor 46. A conventional variable-volume, constant-pressure hydraulic pumping unit that generates pressures of up to 3000 psi drives the motor 46. This power level allows forward and reverse strand accelerations of up to five times the acceleration of gravity (5 g) for average size strands. A conventional electronic programmer (not shown) produces a highly controlled program of signals that controls the operation of the motor 46 through a conventional servo system. The program allows variation in the duration, velocity and acceleration of both forward and reverse motions or "strokes" of the strand, as well as "dwell" period of no relative motion between the strand and the mold assembly following the forward and reverse strokes. The program also includes a programmed start-up routine that gradually ramps up the withdrawal speed. The drive rolls 44 can be individually disengaged from a selected strand 12 without interrupting the advance of the other strands.

Figure 2:
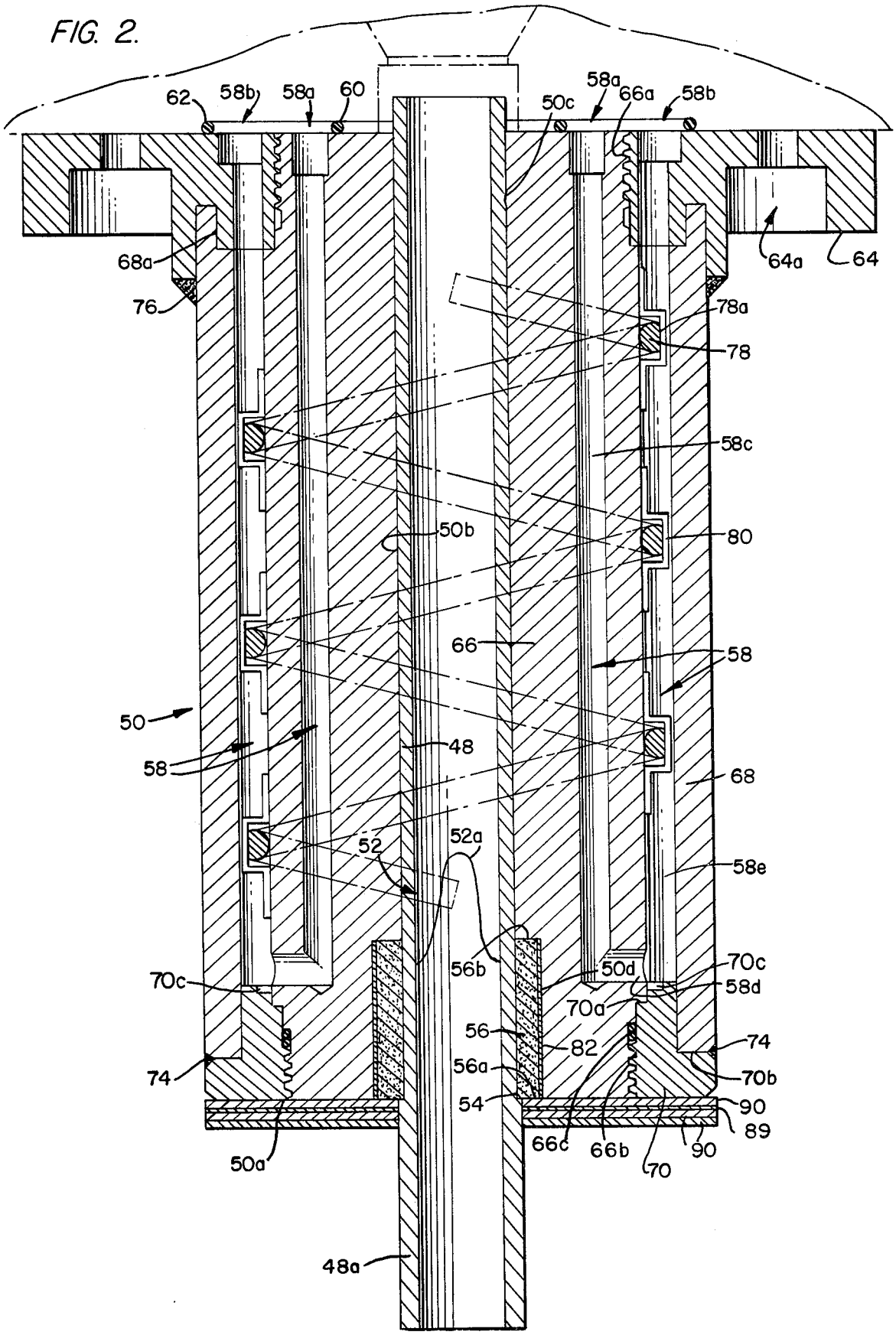
FIG. 2 is a view in vertical section of a preferred embodiment of a mold assembly constructed according to the invention and used in the facility shown in FIG. 1.
Figure 4:
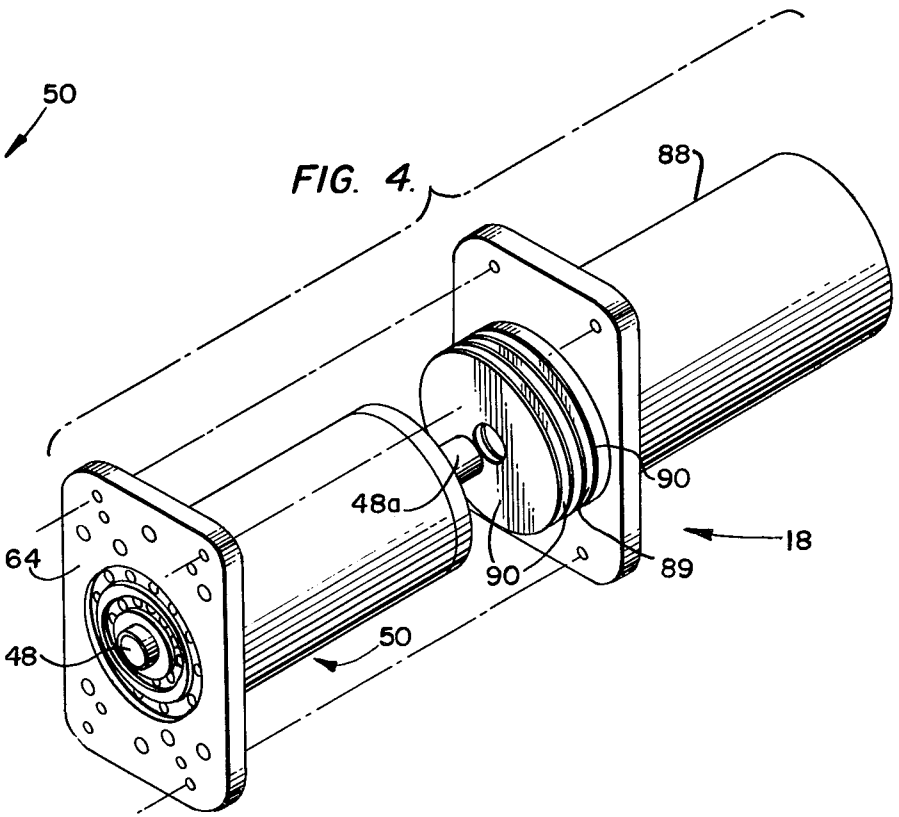
FIG. 4 is an exploded perspective view of the mold assembly shown in FIGS. 2 and 3 and an exterior insulating hat.
Figure 3:
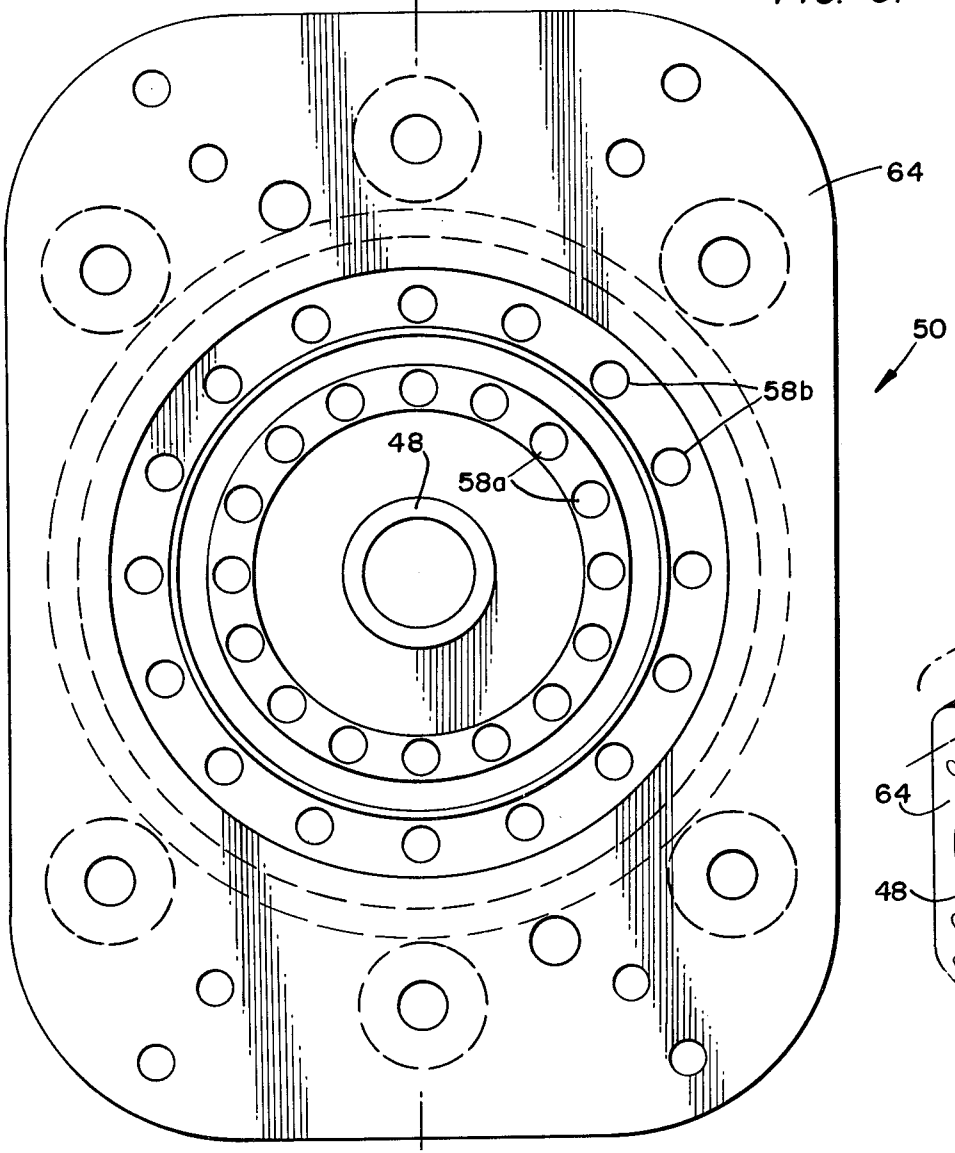
FIG. 3 is a top plan view of the mold assembly shown in FIG. 2.

FIGS. 2–4 show a preferred embodiment of the mold assemblies 18 having a tubular die 48 enclosed by a coolerbody 50. The liner has a lower end portion **48*a* that projects beyond the lower face 50*a* of the coolerbody. The die portion 48*a* and at least a portion of the coolerbody are immersed in the melt 14 during casting. Cuprostatic pressure therefore forces liquid melt into the die toward the coolerbody. On start up, a length of straight rod is inserted into the die and positioned with its lower end, which typically holds a bolt, somewhat above a normal solidification or casting zone 52. The immersion depth is selected so that the liquid melt reaches the casting zone 52 where rapid heat transfer from the melt to the coolerbody solidifies the melt to form a solid casting without running past the starter rod. The melt adjacent the die will cool more quickly than the centrally located melt so that an annular "skin" forms around a liquid core. The liquid-solid interface defines a solidification front 52*a* across the casting zone 52. A principal feature of this invention is that the casting zone is characterized by a high cooling rate and a steep vertical temperature gradient at its lower end so that it extends over a relatively short length of the die 48**.

It should be noted that while this invention is described with respect to a preferred upward casting direction, it can also be used for horizontal and downward casting. Therefore, it will be understood that the term "lower" means proximate the melt and the term "upper" means distal from the melt. In downcasting, for example, the "lower" end of the mold assembly will in fact be above the "upper" end.

The die 48 is formed of a refractory material that is substantially non-reactive with metallic and other vapors present in the casting environment especially at temperatures in excess of 2,000° F. Graphite is the usual die material although good results have also been obtained with boron nitride. More specifically, a graphite sold by the Poco Graphite Company under the trade designation DFP-3 has been found to exhibit unusually good thermal characteristics and durability. Regardless of the choice of material for the die, before installation it is preferably outgassed in a vacuum furnace to remove volatiles that can react with the melt to cause start-up failure or produce surface defects on the casting. The vacuum also prevents oxidation of the graphite at the high outgassing temperatures, e.g. 750° F. for 90 minutes in a roughing pump vacuum. It will be understood by those skilled in the art that the other components of the mold assembly must also be freed of volatiles, especially water prior to use. Components formed of Fiberfrax refractory material are heated to about 1500° F.; other components such as those formed of silica are typically heated to 350° F. to 400° F.

The die 48 has a generally tubular configuration with a uniform inner bore diameter and a substantially uniform wall thickness. The inner surface of the die is highly smooth to present a low frictional resistance to the axial or longitudinal movement of the casting through the die and to reduce wear. The outer surface, also smooth, of the die is pressured contact with the surrounding inner surface **50*b* of the coolerbody 50 during operation. The surface 50*b*** constrains the liner as it attempts to expand radially due to heating by the melt and the casting and promotes a highly efficient heat transfer from the die to the coolerbody by the resulting pressured contact.

The fit between the die and the coolerbody is important since a poor fit, one leaving gaps, severely limits heat transfer from the die to the coolerbody. A tight fit is also important to restrain longitudinal movement of the die with respect to the coolerbody due to friction or "drag" between the casting and the die as the casting is drawn through the die. On the other hand, the die should be quickly and conveniently removable from the coolerbody when it becomes damaged or worn. It has been found that all of these objectives are achieved by machining the mating surfaces of the die and coolerbody to close tolerances that permit a "slip fit" that is, an axial sliding insertion and removal of the die. The dimensions forming the die and mating surface 50b are selected so that the thermal expansion of the die during casting creates a tight fit. While the die material typically has a much lower thermal expansion coefficient ($5\times10^{-6}$ in./in./° F.) than the coolerbody, ($10\times10^{-6}$ in./in./°F.) the die is much hotter than the coolerbody so that the temperature difference more than compensates for the differences in the thermal expansion coefficients. The average temperature of the die in the casting zone through its thickness is believed to be approximately 1000° F. for a melt at 2000° F. The coolerbody is near the temperature of the coolant, usually 80° to 100° F., circulating through it.

Mechanical restraint is used to hold the die in the coolerbody during low speed operation or set-up prior to it being thermally expanded by the melt. A straightforward restraining member such as a screw or retainer plate has proven impractical because the member is cooled by the coolerbody and therefore condenses and collects metallic vapors. This metal deposit can create surface defects in the casting and/or weld the restraining member in place which greatly impedes replacement of the die. Zinc vapor present in the casting of brass is particularly troublesome. An acceptable solution is to create a small upset or irregularity **50*c* on the inner surface 50*b* of the coolerbody, for example, by raising a burr with a nail set. A small step 54 formed on the outer surface of the die which engages the lower face 50*a* of the coolerbody (or more specifically, an "outside" insulating bushing or ring 56 seated in counterbore 50*d*** formed in the lower end of the coolerbody) indexes the die for set-up and provides additional upward constraint against any irregular high forces that may occur such as during start-up. It should also be noted that the one-piece construction of the die eliminates joints, particularly joints between different materials, which can collect condensed vapors or promote their passage to other surfaces. Also, a one-piece die is more readily replaced and restrained than a multi-section die.

Alternative arrangements for establishing a suitable tight-fitting relationship between the die and coolerbody include conventional press or thermal fits. In a press fit, a molybdenum sulfide lubricant is used on the outside surface to reduce the likelihood of fracturing the die during press fitting. The lubricant also fills machining scratches on the die. In the thermal fit, the coolerbody is expanded by heating, the die is inserted and the close fit is established as the assembly cools. Both the press fit and the thermal fit, however, require that the entire mold assembly 18 be removed from the water header 20 to carry out the replacement of a die. This is clearly more time consuming, inconvenient and costly than the slip fit.

While the preferred form of the invention utilizes a one-piece die with a uniform bore diameter, it is also possible to use a die with a tapered or stepped inner surface that narrows in the upward direction or a multi-section die formed of two or more pieces in end-abutting relationship. Upward narrowing is desirable to compensate for contraction of the casting as it cools. Close contact with the casting over the full length of the die increases the cooling efficiency of the mold assembly. Increased cooling is significant because it helps to avoid a central cavity caused by an unfed shrinkage of the molten center of the casting.

To minimize expense, an opposite taper can be machined on the outer surface of the die rather than on its inside surface or the inside surface **50*b*** of the coolerbody. Thermal expansion of the die within the coolerbody bore during casting creates the desired upwardly narrowing taper on the highly smooth inner surface of the die. Multi-section dies can either have the same bore diameter, or different bore diameters to create a stepped upward narrowing. To avoid troublesome accumulations of metal between the die sections, junctions between sections should occur only above the casting zone. Also, the upper section or sections above the casting zone can be press fit since the lower section is the most likely to become damaged and need replacement.

By way of illustration, but not of limitation, a one-piece, die formed of Poco type graphite suitable for casting three-quarter inch rod has a length of approximately ten and one half inches and a uniform wall thickness of approximately one-eighth to one-fifth inch. In general, the wall thickness will vary with the diameter of the casting. The projecting die portion **48*a*** typically has a length of two inches.

The coolerbody 50 has a generally cylindrical configuration with a central, longitudinally extending opening defined by the inner surface **50*b*. The interior of the coolerbody has a passage designated generally at 58 that circulates the cooling fluid, preferably water, through the coolerbody. A series of coolant inlet openings 58*a* and coolant outlet openings 58*b* are formed in the upper end of the coolerbody. As is best seen in FIGS. 3 and 4, these openings are arrayed in concentric circles with sufficient openings to provide a high flow rate, typically one gallon per pound of casting per minute. A pair of O-rings 60 and 62, preferably formed of a long wearing fluoro-elastomer, seal the water header 20 in fluid communication with the inlet and outlet openings. A mounting flange 64 on the coolerbody has openings 64a** that receives bolts (not shown) to secure the mold assembly to the water header. This flange also includes a hole (not shown) to vent gases from the annular space between the coolerbody and the hat through a tube (not shown) in the waterheader to atmosphere.

The coolerbody has four main components: an inner body 66, an outer body 68, a jacket closure ring 70 and the mounting flange 64. The inner body is formed of alloy that exhibits excellent heat transfer characteristics, good dimensional stability and is hard and wear resistant. Age hardened copper such as the alloy designated CDA 182 is preferred. The outer body 68, closure ring 70 and mounting flange 64 are preferably formed of stainless steel, particularly free machining 303 stainless for the ring 70 and flange 64 and 304 stainless for the outer body 68. Stainless exhibits satisfactory resistance to mechanical abuse, possesses similar thermal expansion characteristics as chrome copper, and holds up well in the casting environment. By the use of stainless steel, very large pieces of age hardened copper are not required thus making manufacture of the coolerbody more practical.

The inner body is machined from a single cylindrical billet of sound (crack-free) chrome copper. Besides cost and functional durability advantages, the composite coolerbody construction is dictated by the difficulty in producing a sound billet of chrome copper which is large enough to form the entire coolerbody. Longitudinal holes 58c are deep drilled in the inner body to define the inlets 58a. The holes 58c extend at least to the casting zone and preferably somewhat beyond it as shown in FIG. 2. Cross holes 58d are drilled to the bottom of the longitudinal holes 58c. The upper and lower ends of the inner body are threaded at 66a and 66b to receive the mounting flange 64 and the closure ring 70, respectively, for structural strength. The closure ring has an inner upwardly facing recess 70a that abuts a mating step machined on the inner body for increased braze joint efficiency, to retard the flow of cooling water into the joint, and to align the ring with the inner body. An outer, upwardly facing recess 70b seats the lower end of the outer body 68 in a fluid tight relationship.

Because the threaded connection at 66b will leak if not sealed well and is required to withstand re-solutionizing and aging of softened coolerbody bores, the joint is also copper/gold brazed. While cooper/gold brazing is a conventional technique, the following procedures produce a reliable bond that holds up in the casting environment. First, the mating surfaces of the closure ring and the inner body are copper plated. The plating is preferably 0.001 to 0.002 inch thick and should include the threads, the recess 70a and groove 70c. The braze material is then applied as by wrapping a wire of the material around the inner body in a braze clearance 66c above the threads, and in the groove 70c atop closure ring 70. Two turns of a one-sixteenth inch diameter wire that is sixty percent copper and forty percent gold is recommended in clearance 66c and three turns in groove 70c. A braze paste of the same alloy is then spread over the mating surfaces. The closure ring is tightly screwed onto the inner body and the assembly is placed in a furnace, brazed end down, and preferably resting on a supported sheet of alumina silica refractory paper material such as the product sold by Carborundum Co. under the trade designation Fiberfrax. The brazing temperature is measured by a thermocouple resting at the bottom of one of the longitudinal holes 58c. The furnace brings the assembly to a temperature just below the fusing point of the braze alloy for a short period of time such as 1760° F. to 1790° F. for ten minutes. The furnace atmosphere is protected (inert or a vacuum) to prevent oxidation. The assembly is then rapidly heated to a temperature that liquifies the braze alloy (1860° F. to 1900° F.) and immediately allowed to cool to room temperature, again in a protected atmosphere. Solution treating of the chrome copper is best performed at a separate second step by firing the part to 1710°-1750° F. for 15 minutes in a protected atmosphere and followed by liquid quenching.

Once the closure ring is joined to the inner body, the remaining assembly of the coolerbody involves TIG welding type 304 to type 303 stainless steel using type 308 rod after preheating parts to 400° F. The outer body 68, which has a generally cylindrical configuration, is welded at 74 to the closure ring. The upper end of the outer body has an inner recess 68a that mates with the mounting flange 64 just outside the water outlet openings 58b. A weld 76 secures those parts. The closure ring and mounting flange space the outer body from the inner body to define an annular water circulating passage 58e that extends between the cross holes 58d and the outlet openings 58b. A helical spacer 78 is secured in the passage 58e to establish a swirling water flow that promotes a more uniform and efficient heat transfer to the water. The spacer 78 is preferably formed of one-quarter inch copper rod. The spacer coil is filed flat at points 78a to allow clearance for holding clips 80 secured to the inner body. A combination aging (hardening) treatment of the chrome copper and stress relief of the welded stainless steel is accomplished at 900° F. for at least two hours in a protected atmosphere. The coolerbody is then machined and leak tested.

By way of illustration only, cooling water is directed through the inlets 58a, the holes 58c and 58d and the spiral flow path defined by the passage 58e and the spacer 78 to the outlets 58b. The water is typically at 80° to 90° F. at the inlet and heats approximately ten to twenty degrees during its circulation through the coolerbody. The water typically flows at a rate of about one gallon per pound of strand solidified in the casting zone per minute. A typical flow rate is 25 gallons per minute. The proper water temperature is limited at the low end by the condensation of water vapor. On humid days, condensation can occur at 70° F. or below, but usually not above 80° F. Water temperatures in excess of 120° F. are usually not preferred. It should be noted that the inlet and outlet holes can be reversed, that is, the water can be applied to the outer ring of holes 58b and withdrawn from the inner ring of holes 58a with no significant reduction in the cooling performance of the coolerbody. The spacing between the liner and the inner set of holes is, however, a factor that affects the heat transfer efficiency from the casting to the water. For a three-quarter inch strand 12, the spacing is typically approximately ⅝ inch. This allows the inner body 66 to be rebored to cast a one inch diameter strand and accept a suitably dimensional outside insulator 56. In general, the aforedescribed mold assembly provides a cooling rate that is high compared to conventional water jacket coolers for chilled mold casting in closed systems.

Another important feature of this invention is the outside insulating bushing 56 which ensures that the die is dimensionally uniform in the casting zone and prevents an excessive outward expansion of the die below the zone (bell-mouthing) that can lead to termination, start up defects, or surface defects. The bushing 56 is also important in creating a steep axial die temperature gradient immediately below the casting zone. For example, without the bushing 56, a sharp temperature gradient would exist at the entrance of the die into the coolerbody causing the lower portion 48*a* of the die to form a bell-mouth casting skin. The enlarged portion cannot be drawn into the coolerbody past the casting zone. It wedges, breaks off from the casting, and can remain in place as casting continues. This wedged portion can result in poor surface quality or termination of the strand. The bushing 56 prevents this problem by mechanically restraining the outward expansion of the die immediately below the casting zone 52. It also insulates the die to a great extent from the coolerbody to create a gentle thermal gradient in the die over the region extending from the lower coolerbody face 50*a* to somewhat below the lower edge of the casting zone 52.

The bushing 56 is formed of a refractory material that has a relatively low coefficient of thermal expansion, a relatively low porosity, and good thermal shock resistance. The low coefficient of thermal expansion limits the outward radial pressures exerted by the bushing on the coolerbody and with the coolerbody constrains the graphite die to maintain a substantially uniform die inner diameter. The low coefficient of thermal expansion also allows the bushing 56 to be easily removed from the coolerbody by uniformly heating the assembly to 250° F. A suitable material for the bushing 56 is cast silica glass ($SiO_2$) which is machinable.

The bushing 56 extends vertically from a lower end surface 56*a* that is flush with the lower cooler body face 50*a* to and upper end surface 56*b* somewhat above the lower edge of the casting zone. In the production of three-quarter inch brass rod, a bushing having a wall thickness of approximately one-quarter inch and a length of one and three-eighth inches has yielded satisfactory results.

In practice, it has been found that metallic vapors penetrate between the inside insulating bushing 56 and the coolerbody counterbore 50*d*, condense, and bond the ring to the coolerbody making it difficult to remove. A thin foil shim 82 of steel placed between the ring and the counterbore solves this problem. The bushing and the shim are held in the counterbore by a special thermal fit, that is, one which allows easy assembly and removal when the bushing and the coolerbody are heated to 400° F.

Figure 9:
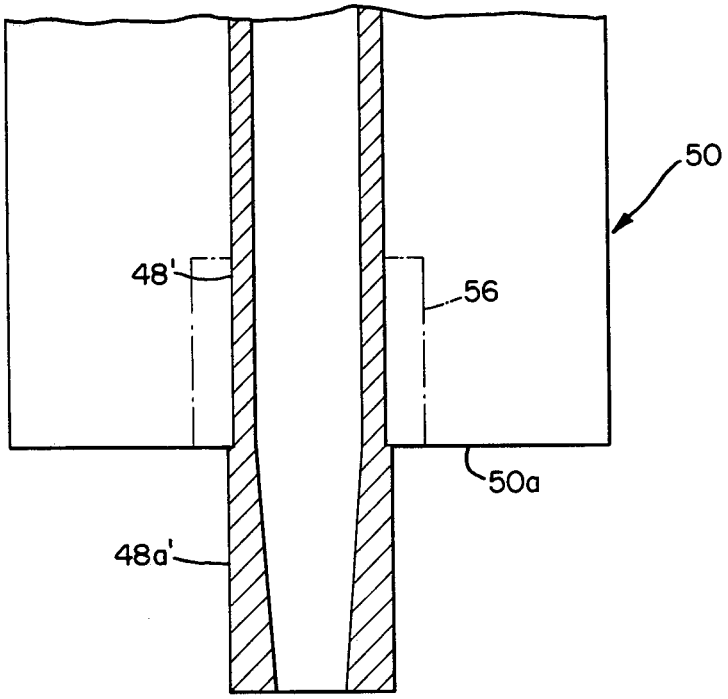
FIGS. 9 and 10 are simplified views in vertical section of alternative arrangements for controlling the expansion of the die below the casting zone.
Figure 10:
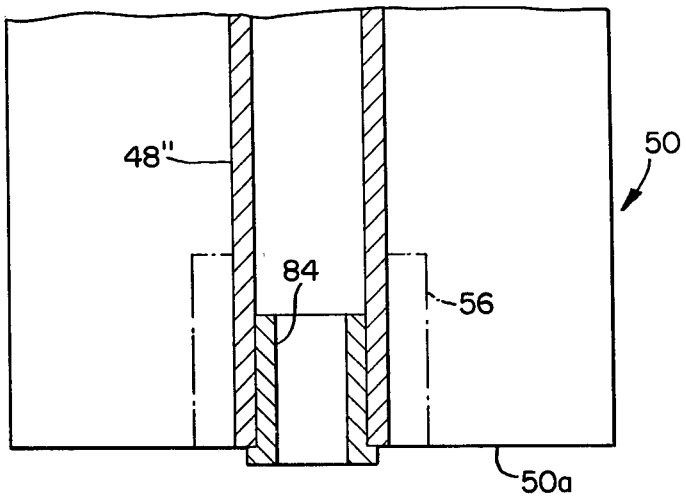

FIGS. 9 and 10 illustrate alternative arrangements for ensuring that the casting occurs in a dimensionally uniform portion of the die and for controlling the expansion of the die below the casting zone. FIG. 9 shows a die 48' which is identical to the die 48 except that the projecting lower portion 48*a'* has an upwardly expanding taper formed on its inner surface. The degree of taper is selected to produce a generally uniform diameter bore when the die portion expands in the melt. This solution, however, is difficult to fabricate. Also, in practice, it is nevertheless necessary to use the bushing 56 (shown in phantom) as well as the die 48' to achieve the high production speeds and good casting quality characteristics of this invention.

FIG. 10 shows an "inside" insulator 84 that slips inside a die 48'' which is the same as the die 48 except is terminated flush with the coolerbody face 50*a*. The inside insulator 84 is formed of refractory material that does not react with the molten metal and has a relatively low thermal expansion so that it does not deform the coolerbody. The lower end of the insulator 84 extends slightly beyond the lower end of the die 48'' and the coolerbody while it has an enlarged outer diameter to form a step 84' similar in function to the step 54 on the die 48. The upper end should be placed near the lower end of the casting zone, usually ½ inch below the upper edge of the bushing 56. If the upper end extends too high, relative to the outside insulator, the strand will cast against the insulator leaving indentations in the strand. The bore dimensions of the inside insulator are also significant, particularly on start up, during a hold, or during a slow down because the melt begins to solidify on the inside insulator 84. To prevent termination, the inner surface of the insulator 84 must be smooth and tapered to widen upwardly. As with the die 48', the outside insulator or bushing 56 is used in conjunction with the inside insulator 84 to reduce the aforementioned difficulties.

Figure 5:
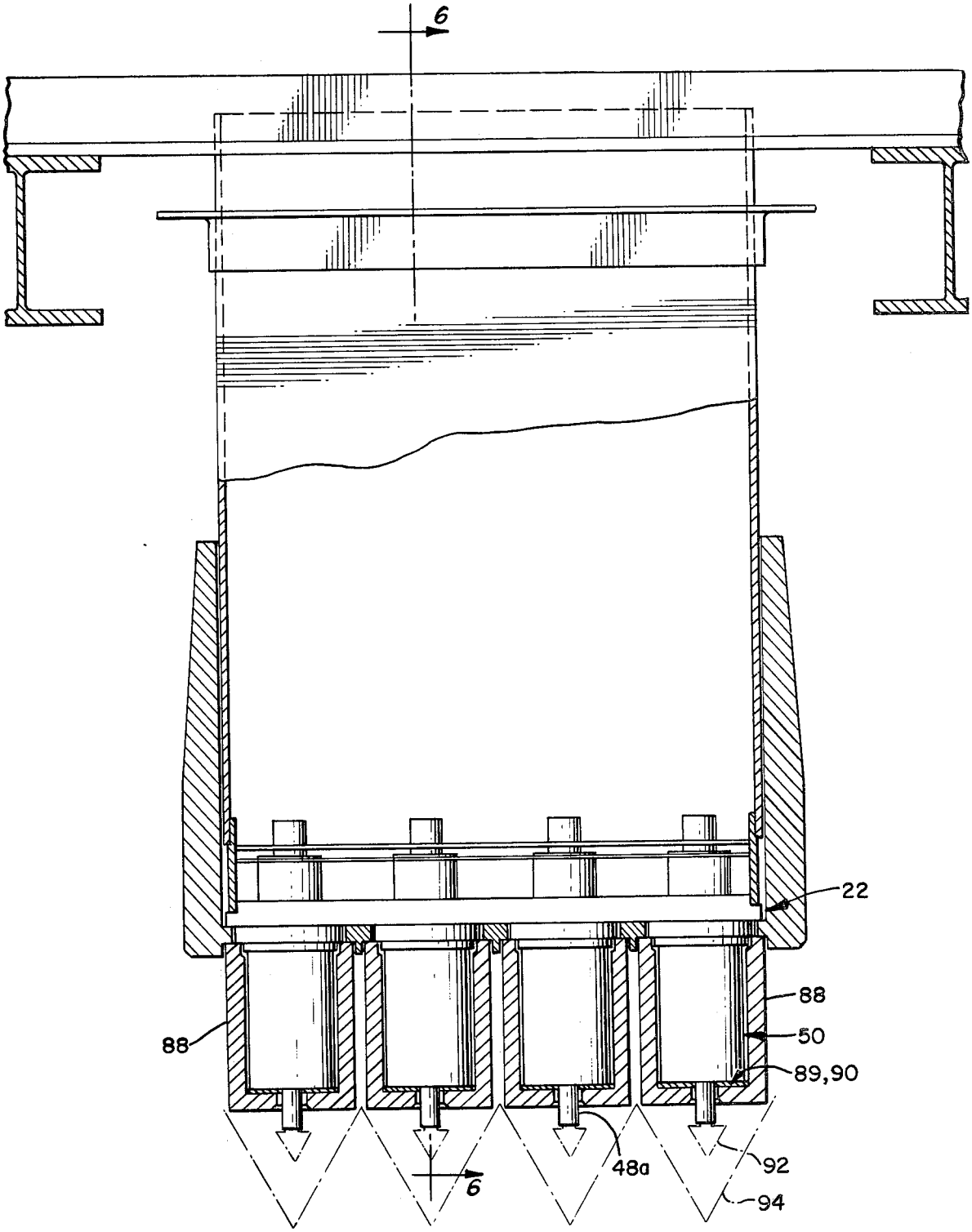
FIG. 5 is a view in vertical section of the mold assemblies shown in FIG. 1.
Figure 6:
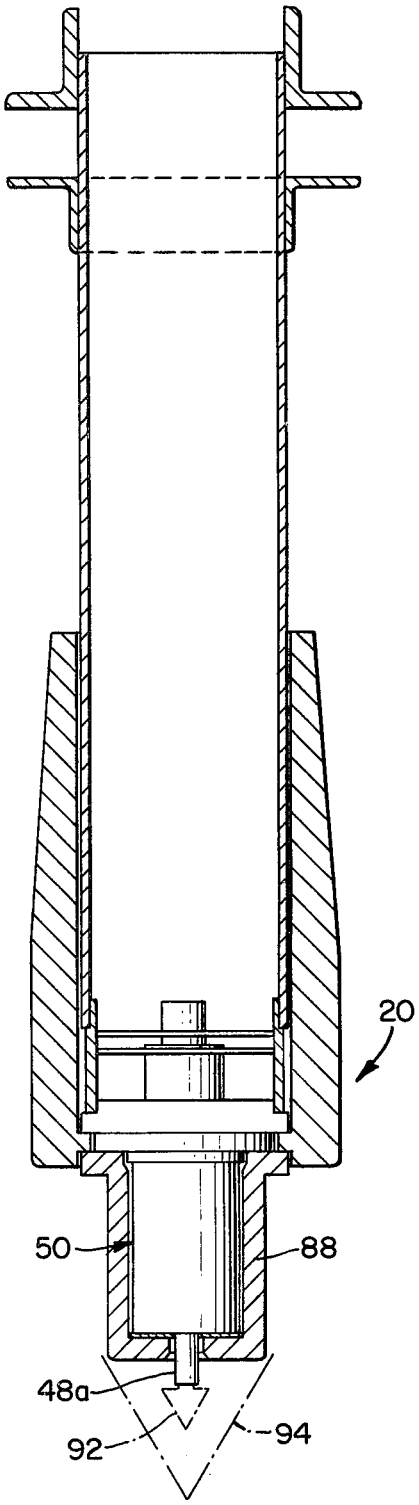
FIG. 6 is a view in vertical section taken along the line 6—6 of FIG. 5.

As is best seen in FIGS. 4–6 an insulating hat 88 encloses the coolerbody to protect it from the melt. The lower face of the hat is generally coextensive with the coolerbody face 50*a* and a mounting flange 64. The hat 88 is formed from any suitable refractory material such as cast silica. The hat allows the mold assembly to be immersed in the melt to any preselected depth. While immersion to a level below the casting zone is functional, the extremely high production speed characteristics are in part a result of a relatively deep immersion, at least to the level of the casting zone and preferably to at least the mid point of the coolerbody. One advantage of this deep immersion is to facilitate feeding the melt to the liquid core of the casting in the casting zone.

A vapor shield 89 and gaskets 90 are placed in the gap between the hat and the coolerbody adjacent the die to prevent the melt and vapors from entering the gap and to further thermally insulate the coolerbody. The gaskets are preferably three or four annular layers or "donuts" of the aforementioned "Fiberfrax" refractory fiber material while the vapor shield is preferably a "donut" of molybdenum foil interposed between the gaskets 90. The shield 89 and gaskets 90 extend from the die extension 48*a* to the outer diameter of the coolerbody. The combined thickness of these layers is sufficient to firmly engage the coolerbody face 50*a* and the end face of the hat 88, typically one-quarter inch.

Figure 8:
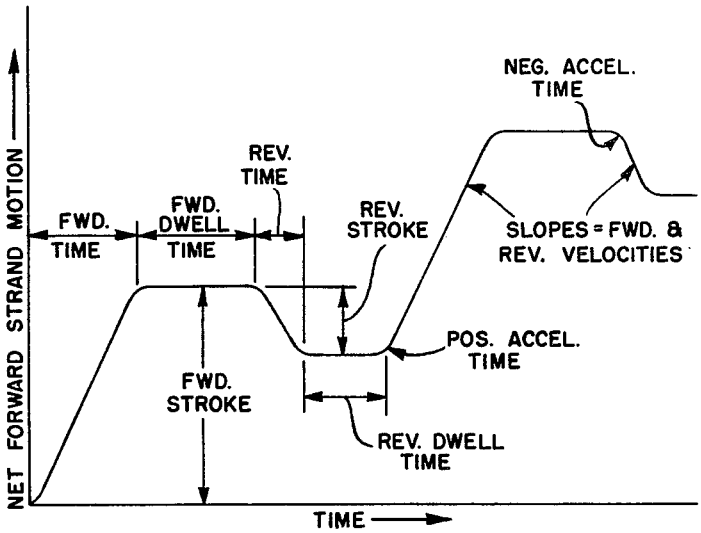
FIG. 8 is a graph showing the net forward strand motion as a function of time.

Another significant aspect of the present invention is the strand withdrawal pattern carried out by the withdrawal machine 22. High quality strands can be cast at exceptionally high speeds using the mold assembly 18 in conjunction with a cycled program of forward and reverse strokes. The forward strokes are characterized by a high forward velocity and long stroke length (FIG. 8). The reverse strokes are characterized by a comparatively short stroke length. Both the forward and reverse strokes are also characterized by high accelerations, typically greater than the acceleration of gravity (1 g). In a preferred form a dwell period (no drive wheel motion) is provided after the reverse stroke. The reverse stroke and dwell period allow "healing time" for the new skin of solidified metal to form adjacent the die.

The forward stroke advances the casting and exposes the solidification zone of the die to fresh molten metal. Sometimes a dwell is used after the forward stroke to prevent buckling in the solidification zone during the reverse stroke.

The frequency of the cycle is relatively low, less than 200 cycles per minute (cpm) and preferably in the range of 60 to 200 cpm. Frequencies in excess of 200 cpm have led to fracture of the strand. A major advantage of the invention is that it is possible to achieve withdrawal rates more than ten times faster than conventional closed mold alloy casting systems. Expressed in a net withdrawal speed, this invention makes feasible high commercial production speeds of eighty to four hundred inches per minute depending on the alloy, strand size, and other variables.

By way of illustration but not of limitation, typically controllable parameters of the withdrawal process can have the following values for the production of three-quarter inch brass rod at a net withdrawal speed in excess of one-hundred inches per minute. The forward velocity ranges up to twenty inches per second with five inches per second being a typical value. Forward time is typically approximately 0.3 second. As a result, the forward stroke is in the range of 1 to 1½ inches. In general, long forward strokes are desirable. The reverse velocity is typically 0.6 inch per second with a reverse time of 0.15 second yielding a reverse stroke of approximately 0.09 inch. Forward acceleration is in the range of 1 to 2 g; reverse acceleration is in the range of 1½ to 5 g. Forward dwell is often not used. Reverse dwell is typically 0.2 second. Heretofore, the high forward velocity and long forward stroke would likely produce fracture in the strand. A significant advantage of this invention is that the mold assembly 18 allows long, high velocity forward strokes without fracture. In turn, the high forward velocity appears to be significant in preventing zinc "run down" along the die, which is a cause of surface defects.

In a typical cycle of operation, the casting furnace 14 is filled with a molten alloy. A rigid, stainless steel rod is used to start up the casting. A steel bolt is screwed into the lower end of the rod. The rod has the dimensions of the strand to be cast, e.g. three quarter inch diameter rod, so that the rod can be fed down through the mold assembly and can be engaged by the withdrawal machine 22.

Whenever the mold assembly is inserted into the melt, a cone 92 of a material non-contaminating to the melt being cast, preferably solid graphite, covers the die portion 48*a* (or a refractory die extension such as the inside insulator 84). An additional alloy cone 94 of a material non-contaminating to the melt, typically copper, covers the lower end of the hat 88. The cones pierce the cover and dross on the surface of the melt to reduce the quantity of foreign particles caught under the coolerbody and in the die. The melt dissolves the cone 94 and the starter rod bolt pushes the smaller graphite cone 92 off the die and it floats to the side. An advantage of the preferred form of this invention utilizing a projecting die portion 48*a* is that it supports and locates the smaller graphite cone 92 on insertion into the melt. To function properly, the surface of the larger cone 94 should form an angle of forty-five degrees or less with the vertical.

After the graphite cone 92 has been displaced, the bolt extends into the melt and the melt solidifies on the bolt. During start up and after the strands have advanced sufficiently above the drive wheels 44, the cast rod is sheared below the steel bolt and the strands are mechanically diverted onto the booms 24, 24'. Before replacing the starter rods in a storage rack for reuse, the short length of casting and the steel bolt is removed. An alternative starter rod design uses a short length of rigid stainless steel rod attached to a flexible cable which can be fed directly onto the boom 24 because of its flexibility. The withdrawal machine is then ramped up to a speed to begin the casting. Between shifts or during temporary interruptions such as for replacement of a coiler, the strand is stopped and clamped. Casting is resumed simply by unclamping and ramping up to full speed.

As the strand 12 is withdrawn, forward strokes pull the solidified casting formed in the casting or solidification zone upwardly to expose melt to the cooled die which quickly forms a skin on this newly exposed die surface. The reverse and dwell strokes allow the new skin to strengthen and attach to the previously formed casting. Because of the high cooling rate of the coolerbody and the steep temperature gradient generated by the outside insulator 56, the solidification occurs very rapidly over a relatively short length of the die. As stated earlier, typical melt temperatures for oxygen free copper and copper alloys are 1900° to 2300° F. It is the present best understanding of applicants that the insulators 56 and/or 84 insulate the melt from the coolerbody to maintain the melt below the casting zone near the temperature of the melt in the furnace and that near the upper edge of the insulator the melt temperature drops rapidly. In casting three quarter inch brass rod at over 100 ipm the casting zone extends longitudinally for 1 to 1½ inches. At the top of the castong zone the strand is solid. Estimated average temperature of brass castings in the solidification zone are 1650° to 1750° F. A typical temperature for the brass casting as it leaves the mold assembly is 1500° F. At the upper end of the mold assembly, there is a clearance around the strand to ensure the presence of oxygen or a water saturated atmosphere to burn off zinc vapors before they condense and flow down to the casting zone. The strand thus produced is of exceptionally good quality. The strand is characterized by a fine grain size and dendrite structure, good tensile strength and good ductility.

There has been described a simple, low cost mold assembly and a withdrawal process for use with the mold assembly that are capable of continuously producing high quality metallic strands, particularly brass, at extraordinarily high speeds. In particular, the mold assembly and withdrawal process provide sophisticated solutions to the many serious difficulties attendent the casting environment such as extreme temperatures and temperature differentials, metallic and water vapors, foreign particles present in the casting furnace and differentials in the thermal expansion coefficients of the materials forming the mold assembly.

While the invention has been described with reference to its preferred embodiments, it will be understood that modifications and variations will occur to those skilled in the art. For example, while the die 48 has been described as extending the full length of the coolerbody 50, for many applications it can extend only a short distance above the casting zone. Also, the coolerbody can assume a variety of alternative configurations and dimensions. Such modifications and variations are intended to fall within the scope of the appended claims.

What is claimed and desired to be secured by Letters Patent is:

1. A method for continuously casting a metallic strand from a metallic melt comprising:

providing a die having a first end with a coolerbody having a first end surrounding a portion of said die to enable portions of said die to be cooled and with an insulating member located between a portion of said die and said coolerbody to insulate a portion of said die from the cooling of said coolerbody, the location of said insulating member being at the first end of the coolerbody and extending between said die and said coolerbody a first distance;

immersing said first end of said coolerbody in the melt a distance greater than said first distance to produce a solidification front within the die below the level of the melt when the melt is withdrawn through said coolerbody; and, withdrawing molten metal from the melt through said die while cooling said die through said coolerbody, said cooling completely solidifying the molten metal into a strand within a portion of the die below the level of the melt and above the insulating member, the solidified strand being withdrawn from said melt in a cycled pattern of forward and reverse strokes.

2. The method as set forth in claim 1 wherein a die is provided with a first end which extends beyond the first end of said coolerbody.

3. The method as set forth in claim 2 wherein a die is provided which has an inside surface which tapers with the inside surface widening in a direction away from said first end, towards said insulating member and wherein the heat from said melt expands said die during casting to produce a uniform inside diameter throughout said die when the melt is withdrawn through said die.

4. The method as set forth in claim 1 wherein a cooling fluid is circulated through said coolerbody to a point just above the top of the insulating member to initiate solidification of the melt into a strand within the portion of the die backed by said insulating member and to completely solidify said melt into a strand within a portion of the die above the insulating member.

5. The method as set forth in claim 2 wherein a cooling fluid is circulated through said coolerbody to a point just above the top of the insulating member to initiate solidification of the melt into a strand within the portion of the die backed by said insulating member and to completely solidify said melt into a strand within a portion of the die above the insulating member.

6. The method as set forth in claim 3 wherein a cooling fluid is circulated through said coolerbody to a point just above the top of the insulating member to initiate solidification of the melt into a strand within the portion of the die backed by said insulating member and to completely solidify said melt into a strand within a portion of the die above the insulating member.

7. The method as set forth in claim 4 wherein the part of said coolerbody that are immersed in said melt are protected from the heat of the melt by an insulating material forming an insulating barrier between the melt and the coolerbody.

8. The method as set forth in claim 5 wherein the part of said coolerbody that are immersed in said melt are protected from the heat of the melt by an insulating material forming an insulating barrier between the melt and the coolerbody.

9. The method as set forth in claim 6 wherein the part of said coolerbody that are immersed in said melt are protected from the heat of the melt by an insulating material forming an insulating barrier between the melt and the coolerbody.

10. The method as set forth in claim 4 wherein the cooling fluid travels in an annular circulation path formed between inner and outer space walls in said coolerbody.

11. The method as set forth in claim 5 wherein the cooling fluid travels in an annular circulation path formed between inner and outer space walls in said coolerbody.

12. The method as set forth in claim 6 wherein the cooling fluid travels in an annular circulation path formed between inner and outer space walls in said coolerbody.

13. The method as set forth in claim 7 wherein the cooling fluid travels in an annular circulation path formed between inner and outer space walls in said coolerbody.

14. The method as set forth in claim 10 wherein the cooling fluid travels in an annular circulating path between an inner wall formed of a copper alloy and an outer wall formed of stainless steel.

15. The method as set forth in claim 11 wherein the cooling fluid travels in an annular circulating path between an inner wall formed of a copper alloy and an outer wall formed of stainless steel.

16. The method as set forth in claim 12 wherein the cooling fluid travels in an annular circulating path between an inner wall formed of a copper alloy and an outer wall formed of stainless steel.

17. The method as set forth in claim 13 wherein the cooling fluid travels in an annular circulating path between an inner wall formed of a copper alloy and an outer wall formed of stainless steel.

18. The method according to claim 10 wherein a helical element is disposed in said spacing to produce a swirling fluid flow.

19. The method according to claim 11 wherein a helical element is disposed in said spacing to produce a swirling fluid flow.

20. The method according to claim 12 wherein a helical element is disposed in said spacing to produce a swirling fluid flow.

21. The method according to claim 13 wherein a helical element is disposed in said spacing to produce a swirling fluid flow.

22. The method according to claim 14 wherein a helical element is disposed in said spacing to produce a swirling fluid flow.

23. The method according to claim 15 wherein a helical element is disposed in said spacing to produce a swirling fluid flow.

24. The method according to claim 16 wherein a helical element is disposed in said spacing to produce a swirling fluid flow.

25. The method according to claim 17 wherein a helical element is disposed in said spacing to produce a swirling fluid flow.

26. The method as set forth in claim 1 wherein water is circulated as the cooling fluid at a temperature within the range of 70° F. to 120° F. at a rate of about one gallon of water per pound of said strand solidified in said die per minute.

27. The method as set forth in claim 1 wherein a cone of a material that is noncontaminated to the melt is provided over said first die end and said cone melts after said first die end is immersed in said melt.

28. The method as set forth in claim 2 wherein a cone of a material that is noncontaminated to the melt is provided over said first die end and said cone melts after said first die end is immersed in said melt.

29. The method as set forth in claim 3 wherein a cone of a material that is noncontaminated to the melt is provided over said first die end and said cone melts after said first die end is immersed in said melt.

30. The method as set forth in claim 4 wherein a cone of a material that is noncontaminated to the melt is provided over said first die end and said cone melts after said first die end is immersed in said melt.

31. The method as set forth in claim 14 wherein a cone of a material that is noncontaminated to the melt is provided over said first die end and said cone melts after said first die end is immersed in said melt.

32. The method as set forth in claim 1 wherein the height of said melt is continuously adjusted with respect to said coolerbody.

33. The method as set forth in claim 2 wherein the height of said melt is continuously adjusted with respect to said coolerbody.

34. The method as set forth in claim 3 wherein the height of said melt is continuously adjusted with respect to said coolerbody.

35. The method as set forth in claim 4 wherein the height of said melt is continuously adjusted with respect to said coolerbody.

36. The method as set forth in claim 14 wherein the height of said melt is continuously adjusted with respect to said coolerbody.

37. The method as set forth in claim 27, wherein the height of said melt is continuously adjusted with respect to said coolerbody.

38. The method as set forth in claim 32 wherein the height of said melt is adjusted by an elevator which rises in response to a signal related to the weight of the melt.

39. The method as set forth in claim 33 wherein the height of said melt is adjusted by an elevator which rises in response to a signal related to the weight of the melt.

40. The method as set forth in claim 34 wherein the height of said melt is adjusted by an elevator which rises in response to a signal related to the weight of the melt.

41. The method as set forth in claim 35 wherein the height of said melt is adjusted by an elevator which rises in response to a signal related to the weight of the melt.

42. The method as set forth in claim 36 wherein the height of said melt is adjusted by an elevator which rises in response to a signal related to the weight of the melt.

43. The method as set forth in claim 37 wherein the height of said melt is adjusted by an elevator which rises in response to a signal related to the weight of the melt.

44. The method as set forth in claim 1 wherein said strand is withdrawn from said die in a cycle of forward and reverse strokes with a net forward withdrawal rate of up to 200 to 400 inches per minute.

45. The method as set forth in claim 2 wherein said strand is withdrawn from said die in a cycle of forward and reverse strokes with a net forward withdrawal rate of up to 200 to 400 inches per minute.

46. The method as set forth in claim 6 wherein said strand is withdrawn from said die in a cycle of forward and reverse strokes with a net forward withdrawal rate of up to 200 to 400 inches per minute.

47. The method as set forth in claim 7 wherein said strand is withdrawn from said die in a cycle of forward and reverse strokes with a net forward withdrawal rate of up to 200 to 400 inches per minute.

48. The method as set forth in claim 14 wherein said strand is withdrawn from said die in a cycle of forward and reverse strokes with a net forward withdrawal rate of up to 200 to 400 inches per minute.

49. The method as set forth in claim 38 wherein said strand is withdrawn from said die in a cycle of forward and reverse strokes with a net forward withdrawal rate of up to 200 to 400 inches per minute.

50. The method as set forth in claim 44 wherein said forward stroke length is in the range of 1 to 1½ inches and with an instantaneous forward velocity in the range of 3 to 20 inches per second.

51. The method as set forth in claim 45 wherein said forward stroke length is in the range of 1 to 1½ inches and with an instantaneous forward velocity in the range of 3 to 20 inches per second.

52. The method as set forth in claim 46 wherein said forward stroke length is in the range of 1 to 1½ inches and with an instantaneous forward velocity in the range of 3 to 20 inches per second.

53. The method as set forth in claim 47 wherein said forward stroke length is in the range of 1 to 1½ inches and with an instantaneous forward velocity in the range of 3 to 20 inches per second.

54. The method as set forth in claim 48 wherein said forward stroke length is in the range of 1 to 1½ inches and with an instantaneous forward velocity in the range of 3 to 20 inches per second.

55. The method as set forth in claim 49 wherein said forward stroke length is in the range of 1 to 1½ inches and with an instantaneous forward velocity in the range of 3 to 20 inches per second.

56. The method as set forth in claim 50 wherein forward and reverse accelerations are each in excess of 1 g.

57. The method as set forth in claim 51 wherein forward and reverse accelerations are each in excess of 1 g.

58. The method as set forth in claim 52 wherein forward and reverse accelerations are each in excess of 1 g.

59. The method as set forth in claim 53 wherein forward and reverse accelerations are each in excess of 1 g.

60. The method as set forth in claim 54 wherein forward and reverse accelerations are each in excess of 1 g.

61. The method as set forth in claim 55 wherein forward and reverse accelerations are each in excess of 1 g.

62. The method as set forth in claim 56 wherein the frequency of the cycles of forward and reverse strokes is between the range of 60 to 200 cycles per minute.

63. The method as set forth in claim 57 wherein the frequency of the cycles of forward and reverse strokes is between the range of 60 to 200 cycles per minute.

64. The method as set forth in claim 58 wherein the frequency of the cycles of forward and reverse strokes is between the range of 60 to 200 cycles per minute.

65. The method as set forth in claim 59 wherein the frequency of the cycles of forward and reverse strokes is between the range of 60 to 200 cycles per minute.

66. The method as set forth in claim 60 wherein the frequency of the cycles of forward and reverse strokes is between the range of 60 to 200 cycles per minute.

67. The method as set forth in claim 61 wherein the frequency of the cycles of forward and reverse strokes is between the range of 60 to 200 cycles per minute.

68. The method as set forth in claim 56 wherein each cycle includes a dwell period at the end of at least one of said forward and reverse strokes.

69. The method as set forth in claim 59 wherein each cycle includes a dwell period at the end of at least one of said forward and reverse strokes.

70. The method as set forth in claim 58 wherein each cycle includes a dwell period at the end of at least one of said forward and reverse strokes.

71. The method as set forth in claim 59 wherein each cycle includes a dwell period at the end of at least one of said forward and reverse strokes.

72. The method as set forth in claim 66 wherein each cycle includes a dwell period at the end of at least one of said forward and reverse strokes.

73. The method as set forth in claim 67 wherein each cycle includes a dwell period at the end of at least one of said forward and reverse strokes.

74. The method as set forth in claim 1 wherein said solidified metal is withdrawn in a vertical direction and said melt is positioned below said die.

75. The method as set forth in claim 1 wherein brass is formed into a strand with a diameter in the range of ¼ to 2 inches and said casting speed is in the range of 200 to 400 inches per minute.

76. The method as set forth in claim 1 wherein said drawing is at a net forward casting speed of at least 80 inches per minute.

77. The method as set forth in claim 1 further comprising the step of refraining said die against vertical movement with respect to said coolerbody before said die is heated by said melt.

78. A method for continuously casting a copper strand from a copper melt comprising:

providing a die having a first end with a coolerbody having a first end surrounding a portion of said die to enable portions of said die to be cooled and with an insulating member located between a portion of said die and said coolerbody to insulate a portion of said die from the cooling of said coolerbody, the location of said insulating member being at the first end of the coolerbody and extending between said die and said coolerbody a first distance;

immersing said first end of said coolerbody in the melt a distance greater than said first distance to produce a solidification front within the die below the level of the melt when the melt is withdrawn through said coolerbody; and, withdrawing molten copper from the melt through said die while cooling said die through said coolerbody, said cooling completely solidifying the molten copper into a strand within a portion of the die below the level of the melt and above the insulating member, the solidified strand being withdrawn from said melt in a cycled pattern of forward and reverse strokes.

79. A method for continuously casting a copper alloy strand from a copper alloy melt comprising:

providing a die having a first end with a coolerbody having a first end surrounding a portion of said die to enable portions of said die to be cooled and with an insulating member located between a portion of said die and said coolerbody to insulate a portion of said die from the cooling of said coolerbody, the location of said insulating member being at the first end of the coolerbody and extending between said die and said coolerbody a first distance;

immersing said first end of said coolerbody in the melt a distance greater than said first distance to produce a solidification front within the die below the level of the melt when the melt is withdrawn through said coolerbody; and, withdrawing molten copper alloy from the melt through said die while cooling said die through said coolerbody, said cooling completely solidifying the molten copper alloy into a strand within a portion of the die below the level of the melt and above the insulating member, the solidified strand being withdrawn from said melt in a cycled pattern of forward and reverse strokes.

80. A method for continuously casting a brass strand from a brass melt comprising:

providing a die having a first end with a coolerbody having a first end surrounding a portion of said die to enable portions of said die to be cooled and with an insulating member located between a portion of said die and said coolerbody to insulate a portion of said die from the cooling of said coolerbody, the location of said insulating member being at the first end of the coolerbody and extending between said die and said coolerbody a first distance;

immersing said first end of said coolerbody in the melt a distance greater than said first distance to produce a solidification front within the die below the level of the melt when the melt is withdrawn through said coolerbody; and, withdrawing molten brass from the melt through said die while cooling said die through said coolerbody, said cooling completely solidifying the molten brass into a strand within a portion of the die below the level of the melt and above the insulating member, the solidified strand being withdrawn from said melt in a cycled pattern of forward and reverse strokes.

* * * * *